US009268304B2

(12) United States Patent
Wachi et al.

(10) Patent No.: US 9,268,304 B2
(45) Date of Patent: Feb. 23, 2016

(54) IMAGE FORMING APPARATUS

(71) Applicant: Panasonic Intellectual Property Management Co., Ltd., Osaka (JP)

(72) Inventors: Hayato Wachi, Fukuoka (JP); Youichi Idera, Fukuoka (JP); Masaya Shitami, Fukuoka (JP); Takanori Kitagawa, Fukuoka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/608,019

(22) Filed: Jan. 28, 2015

(65) Prior Publication Data

US 2015/0212485 A1 Jul. 30, 2015

(30) Foreign Application Priority Data

Jan. 29, 2014 (JP) ..... 2014-014585
Jan. 29, 2014 (JP) ..... 2014-014586

(51) Int. Cl.
*G03G 15/02* (2006.01)
*G03G 21/20* (2006.01)
*G03G 15/20* (2006.01)

(52) U.S. Cl.
CPC ..... *G03G 21/206* (2013.01); *G03G 15/2017* (2013.01)

(58) Field of Classification Search
CPC ..... G03G 15/2017; G03G 21/206; G03G 2221/1645
See application file for complete search history.

(56) References Cited

U.S. PATENT DOCUMENTS

| | | | | |
|---|---|---|---|---|
| 4,728,426 | A | 3/1988 | Rudinger et al. | |
| 6,126,707 | A * | 10/2000 | Pitzen | 55/495 |
| 7,526,223 | B2 * | 4/2009 | Adachi et al. | 399/92 |
| 7,747,186 | B2 * | 6/2010 | Miyamoto et al. | 399/92 |
| 2007/0059020 | A1 | 3/2007 | Yoshikawa | |
| 2008/0145092 | A1 | 6/2008 | Tomatsu et al. | |
| 2009/0290897 | A1 | 11/2009 | Doshoda et al. | |

(Continued)

FOREIGN PATENT DOCUMENTS

| | | |
|---|---|---|
| JP | 62-132513 A | 6/1987 |
| JP | 5-019582 | 1/1993 |
| JP | 7-171325 | 7/1995 |

(Continued)

OTHER PUBLICATIONS

Extended European Search Report dated Jun. 2, 2015 for corresponding EP Application No. 15152500.3-1560, 7 pages.

*Primary Examiner* — Gregory H Curran
(74) *Attorney, Agent, or Firm* — Seed IP Law Group PLLC

(57) ABSTRACT

A multi-function printer includes a fuser unit which includes a heat roller and a pressure roller; a duct which is formed in a long shape in a direction along an axis of the heat roller, is disposed in the vicinity of the fuser unit along the axis of the heat roller, and is exhausted by an exhaust fan which is provided on one end side in a long-side direction; an exhaust port which is opened to a first side wall of the fuser unit side of the duct and causes the fuser unit and the duct to communicate with each other; and a planar filter which is attached to an inner wall surface of the duct and in which the surface of the filter is an irregular surface on which ditches and convex portions extending in a direction inclined to the long-side direction of the duct are alternately disposed in the long-side direction of the duct.

7 Claims, 8 Drawing Sheets

(56) References Cited

U.S. PATENT DOCUMENTS

| | | | |
|---|---|---|---|
| 2011/0211859 | A1 | 9/2011 | Shimoyama et al. |
| 2014/0056608 | A1 | 2/2014 | Miura |

FOREIGN PATENT DOCUMENTS

| | | | |
|---|---|---|---|
| JP | 10-268735 | | 10/1998 |
| JP | 11-047531 | A | 2/1999 |
| JP | 2001-117472 | | 4/2001 |
| JP | 2002-58943 | A | 2/2002 |
| JP | 2002-318514 | A | 10/2002 |
| JP | 2003-140514 | A | 5/2003 |
| JP | 2003-181231 | A | 7/2003 |
| JP | 2006-208718 | | 8/2006 |
| JP | 2007-079184 | A | 3/2007 |
| JP | 2008-139703 | | 6/2008 |
| JP | 2009-145729 | | 7/2009 |
| JP | 2009-192679 | | 8/2009 |
| JP | 2009-282455 | A | 12/2009 |
| JP | 2011-107500 | | 6/2011 |
| JP | 2011-180235 | A | 9/2011 |
| JP | 2011-180283 | A | 9/2011 |
| JP | 2012-032663 | | 2/2012 |
| JP | 2013-033197 | | 2/2013 |
| JP | 2014-044238 | | 3/2014 |
| JP | 5506071 | | 5/2014 |
| JP | 5595610 | | 9/2014 |

* cited by examiner

IMAGE FORMING APPARATUS

BACKGROUND OF THE INVENTION

1. Field of the Invention

The present invention relates to an electrophotographic image forming apparatus.

2. Description of the Related Art

In an electrophotographic image forming apparatus, it is known that a plurality of kinds of chemical substances are discharged from an image forming apparatus during image forming. For example, as a representative of the discharged chemical substances, there is ozone generated when a photosensitive drum is charged, or toner dust generated during developing or fusing. In the related art, in order to not allow the generated chemical substances to be discharged outside the image forming apparatus, for example, a measure of providing a filter or the like is performed.

For example, in a volatile chemical substance collection device of an electronic apparatus disclosed in Japanese Patent Unexamined Publication No. 2009-282455, an electric field is generated in an atmosphere from an electric field generating collection member in an exhaust duct provided above a fuser unit, and volatile organic compounds (VOC) included in the atmosphere are drawn to the surface of the electronic field generating collection member by the operation of the electric field so as to be collected.

In an image forming apparatus disclosed in Japanese Patent Unexamined Publication No. 2011-180235, a duct which includes a take-in port for taking-in minute particles generated from a heat roller inside a fusing device is provided in the vicinity of the fusing device. An exhaust fan which generates a flow of air from the take-in port toward an outlet is provided in an expansion portion of the duct, and a first filter member is provided on the upstream side of the exhaust fan. The first filter member captures ultrafine particles (for example, siloxane) generated from a rubber layer configuring the fusing device. A shutter which closes a gap between the first filter member and the expansion portion is provided, and a control portion of the image forming apparatus switches a state where the shutter closes a first filter portion and a state where the shutter does not close the first filter portion according to a predetermined initial burst condition.

In an odor removing device of a multi-function image forming apparatus disclosed in Japanese Patent Unexamined Publication No. 2011-180283, a plurality of air passage portions for introducing air inside a housing are formed on a housing bottom portion. Each air passage portion is a cylindrical body in which an inner diameter of the upper portion side inside the housing is smaller than an inner diameter of the housing bottom portion, and an ozone decomposition filter including an ozone decomposition catalyst is disposed on an inner diameter surface of the cylindrical body. A waste liquid absorbing material is disposed on the bottom portion inside the housing, a deodorizing absorbent is disposed on an upper cover inside the housing, and an exhaust port of the air passing through a portion between the waste liquid absorbing material and the deodorizing absorbent is provided on the side surface of the housing.

However, in recent years, according to enhancement in consciousness with respect to worldwide environment protection, minute particles (for example, ultrafine particles (UFP) having a particle diameter less than or equal to 100 nm) different from ozone or the like occurring from an electrophotogrpahic image forming apparatus have become a problem.

As a structure which captures the ultrafine particles, for example, like the electronic apparatus disclosed in Japanese Patent Unexamined Publication No. 2009-282455, when the volatile chemical substance collection device which draws volatile organic compounds to the surface of the electric field generating collection member and collects the compounds is additionally provided, there is a problem in that the structure becomes complicated.

For example, as the image forming apparatus disclosed in Japanese Patent Unexamined Publication No. 2011-180235, when the structure in which the first filter member capable of capturing minute particles is provided on the upstream side of the exhaust fan and the exhaust gas permeates the first filter member is provided, the first filter member increases resistance when the air is transported, and thus, exhaust efficiency is decreased and the temperature inside the housing is increased. Accordingly, the output of the exhaust fan should be increased, and thus, there is a problem that noise is generated and running cost is increased.

For example, as the multi-function image forming apparatus disclosed in Japanese Patent Unexamined Publication No. 2011-180283, when the plurality of (for example, two in Japanese Patent Unexamined Publication No. 2011-180283) exclusive odor removing devices are additionally provided, the structure becomes complicated and, there is a problem that a cost of the apparatus is also increased.

The present invention is made for solving the above-described problems in the related art, and an object thereof is to provide an image forming apparatus which decreases amounts of emission of ultrafine particles and suppresses an increase of output of the exhaust fan by a simple structure.

SUMMARY OF THE INVENTION

According to the present invention, there is provided an image forming apparatus including: a fuser unit which includes a heat roller and a pressure roller which heats and pressurizes a sheet on which an unfused toner image is carried and fuses the unfused toner image on the sheet; a duct which is formed in a long shape in a direction along an axis of the heat roller, is disposed in the vicinity of the fuser unit along the axis of the heat roller, and is exhausted by an exhaust fan which is provided on one end side in a long-side direction; an exhaust port which is opened to a first side wall of the fuser unit side of the duct and causes the fuser unit and the duct to communicate with each other; and a planar filter which is attached to an inner wall surface of the duct, in which the surface of the filter is an irregular surface on which ditches and convex portions extending in a direction inclined to the long-side direction of the duct are alternately disposed in the long-side direction of the duct.

According to the present invention, it is possible to decrease an amount of emission of ultrafine particles and suppress an increase in output of the exhaust fan, by a simple structure.

BRIEF DESCRIPTION OF DRAWINGS

FIG. 2 is cut at an approximately center position in a long-side direction of a heat roller;

FIG. 3 is viewed from the lower portion of a duct side;

DETAILED DESCRIPTION OF THE PREFERRED EMBODIMENTS

Hereinafter, an embodiment (hereinafter, referred to as the "present embodiment") of an image forming apparatus according to the present invention will be described with reference to the drawings. In the present embodiment below, as an example of the image forming apparatus according to the present invention, an electrophotographic multi-function printer will be described. However, the image forming apparatus according to the present invention is not limited to the multi-function printer, and for example, may be also applied to a copier or printer.

Figure 1:
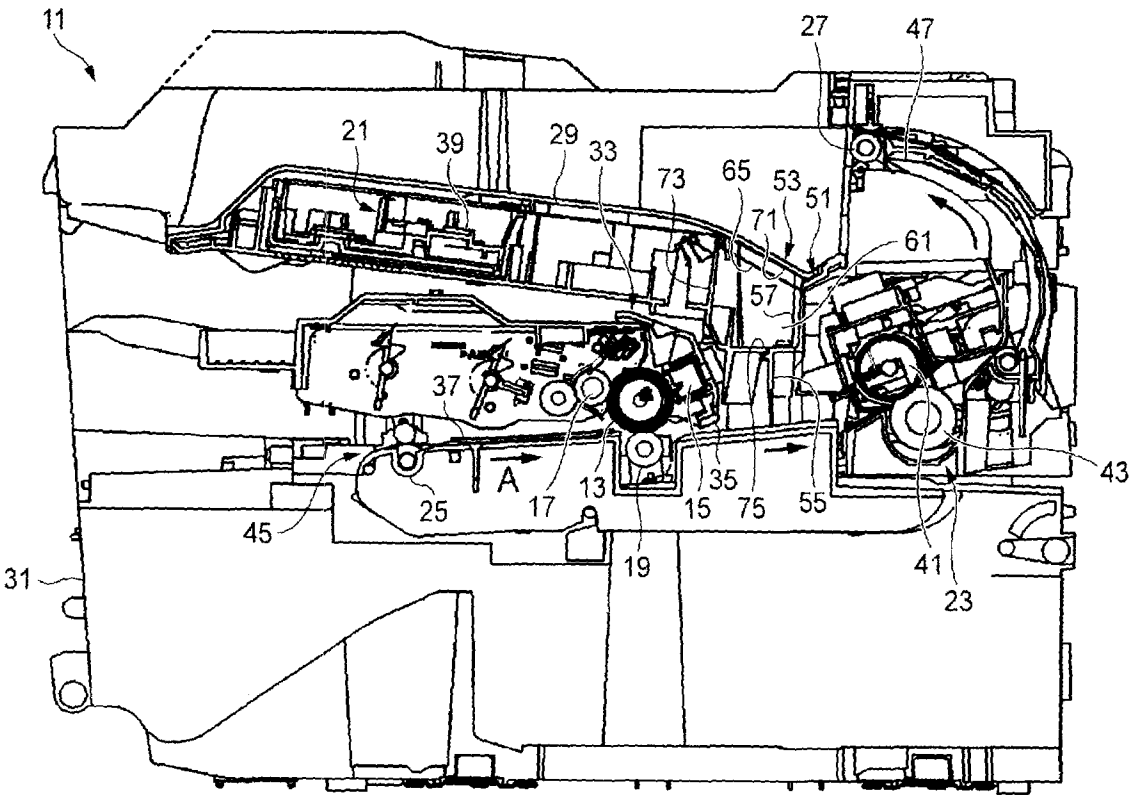
FIG. 1 is a longitudinal cross-sectional view of a multi-function printer of the present embodiment.
Figure 2:
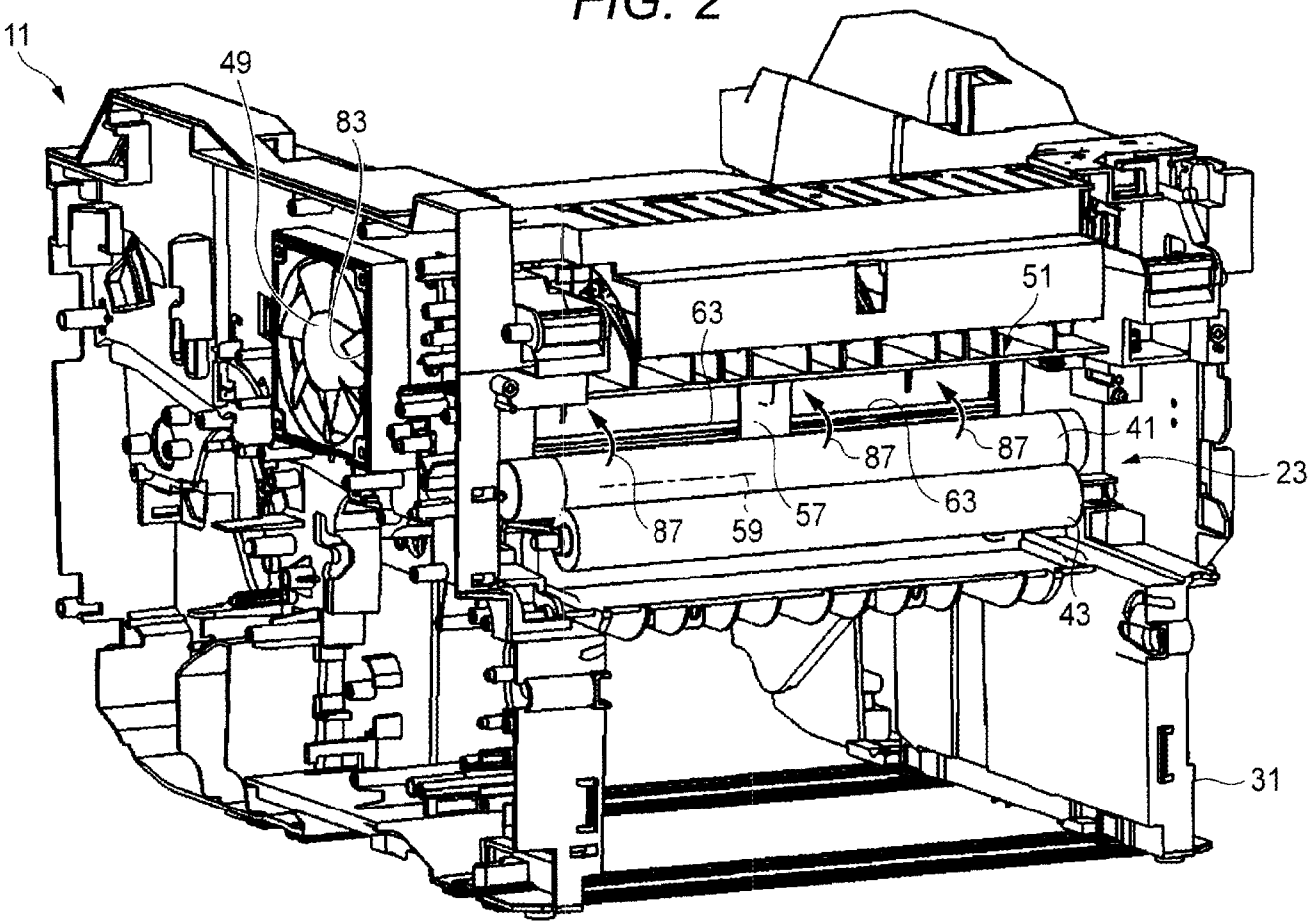
FIG. 2 is a perspective view when a first side wall of the multi-function printer shown in FIG. 1 is viewed from a fuser unit container side.
Figure 3:
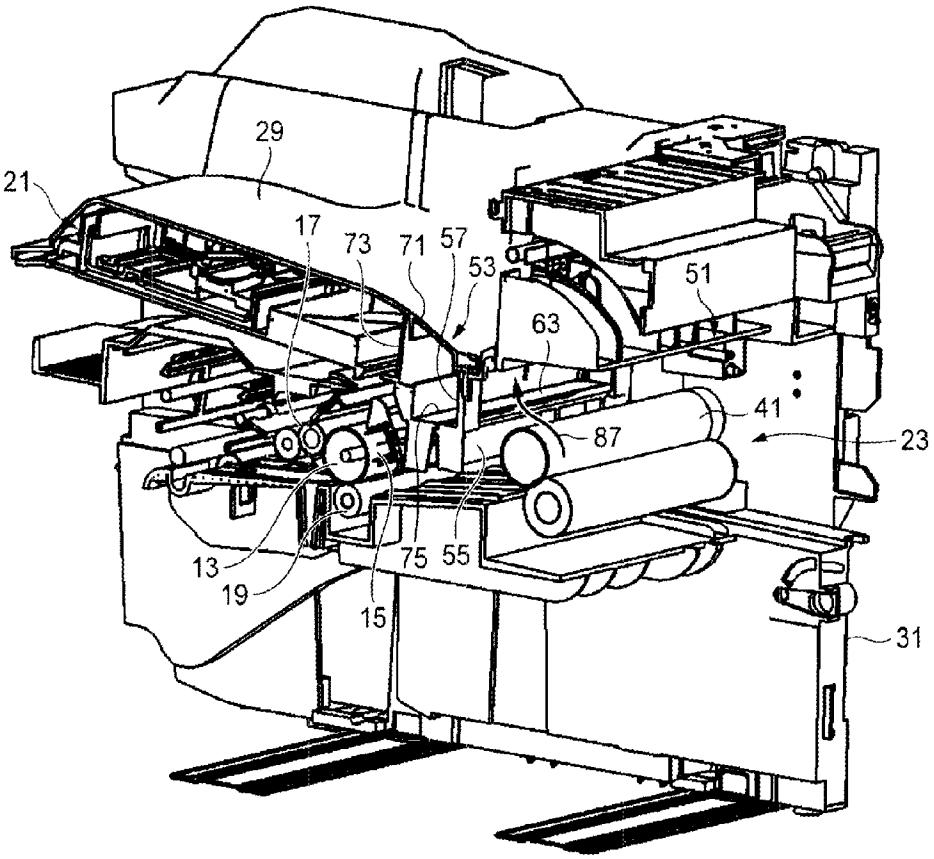
FIG. 3 is a perspective view when
Figure 4:
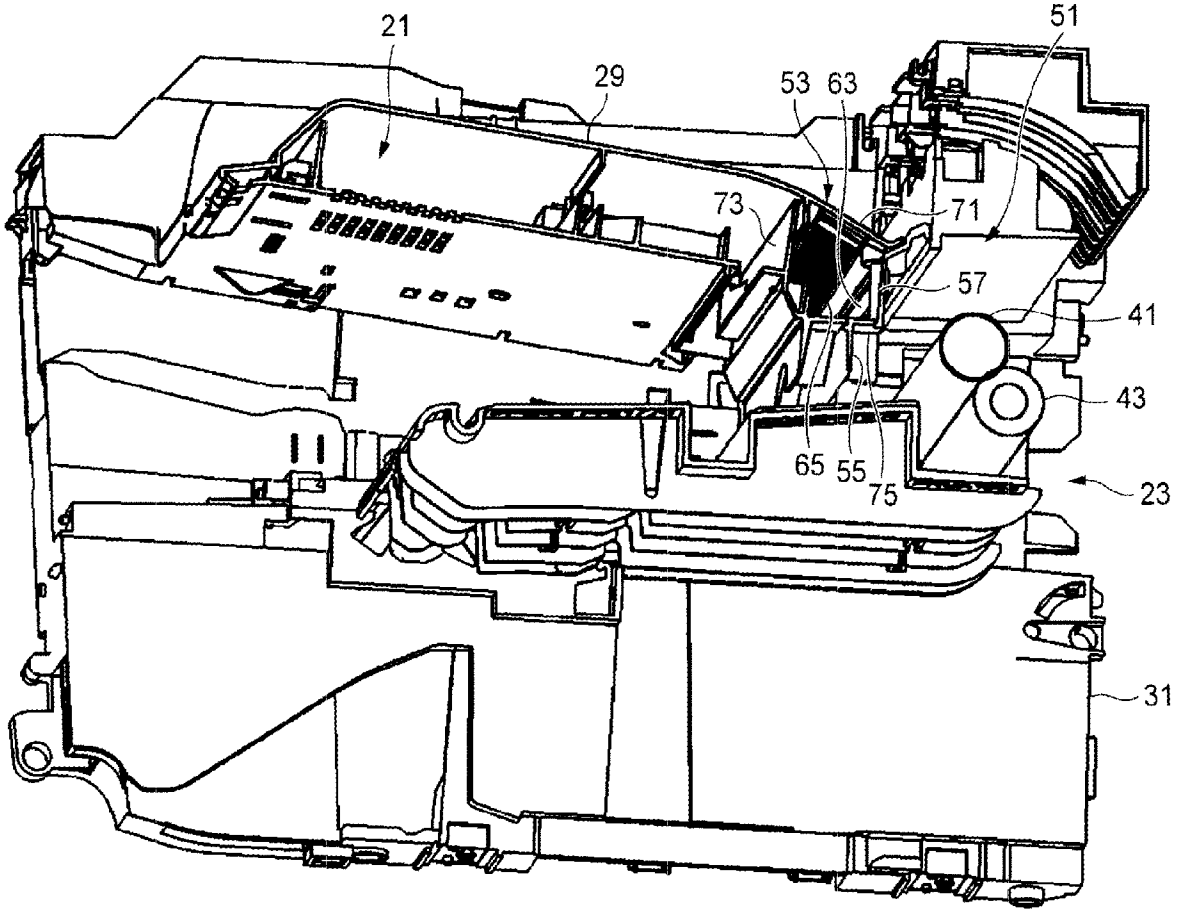
FIG. 4 is a perspective view when
Figure 5:
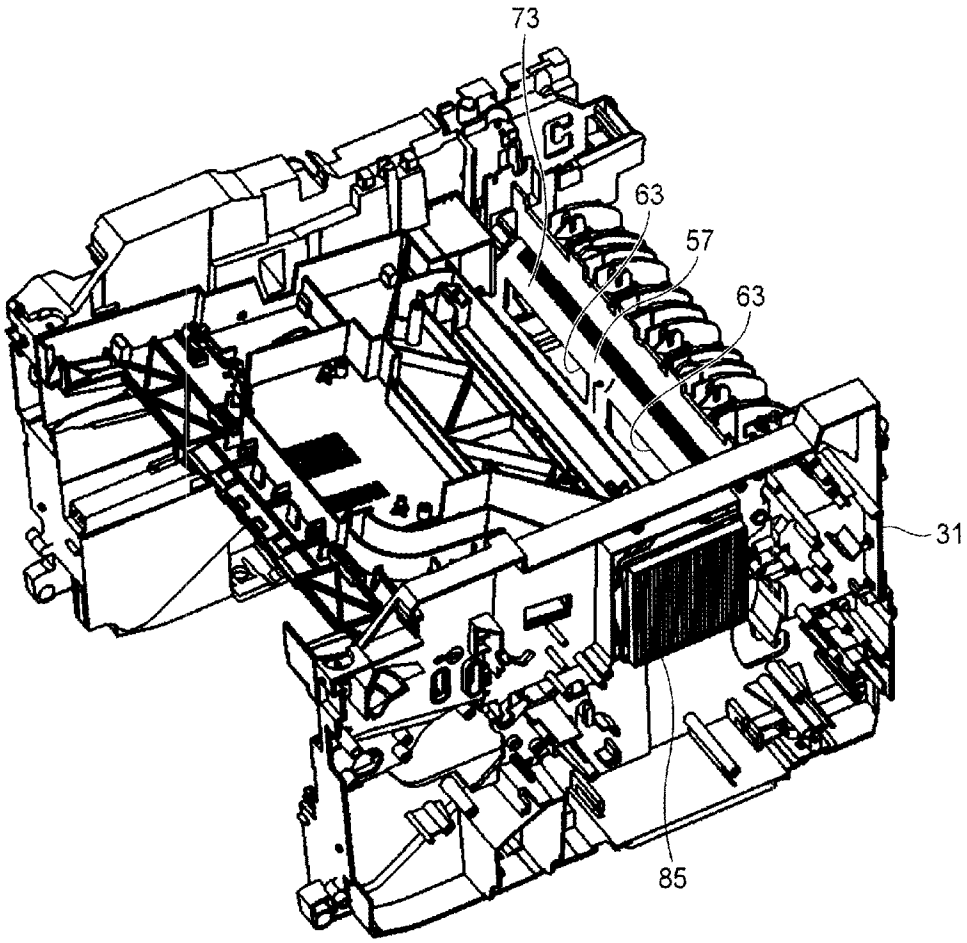
FIG. 5 is a perspective view when an exhaust port of a first side wall is viewed from the upper portion in a state where a ceiling surface of the duct of the multi-function printer of the present embodiment is not shown.
Figure 6:
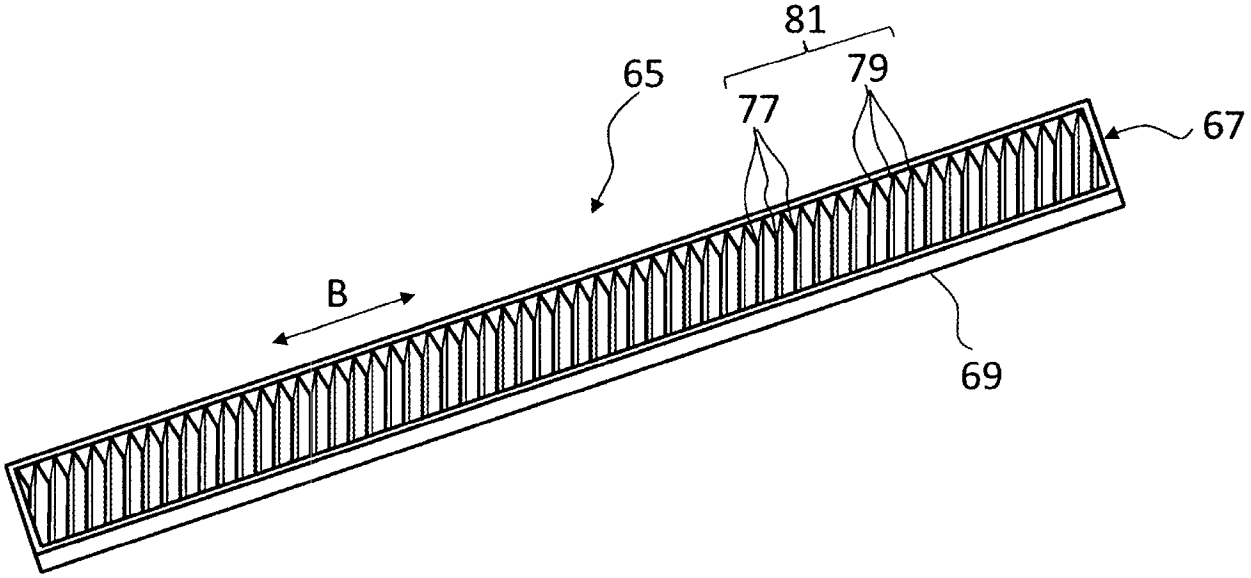
FIG. 6 is a perspective view of a filter in the multi-function printer of the present embodiment.
Figure 7:
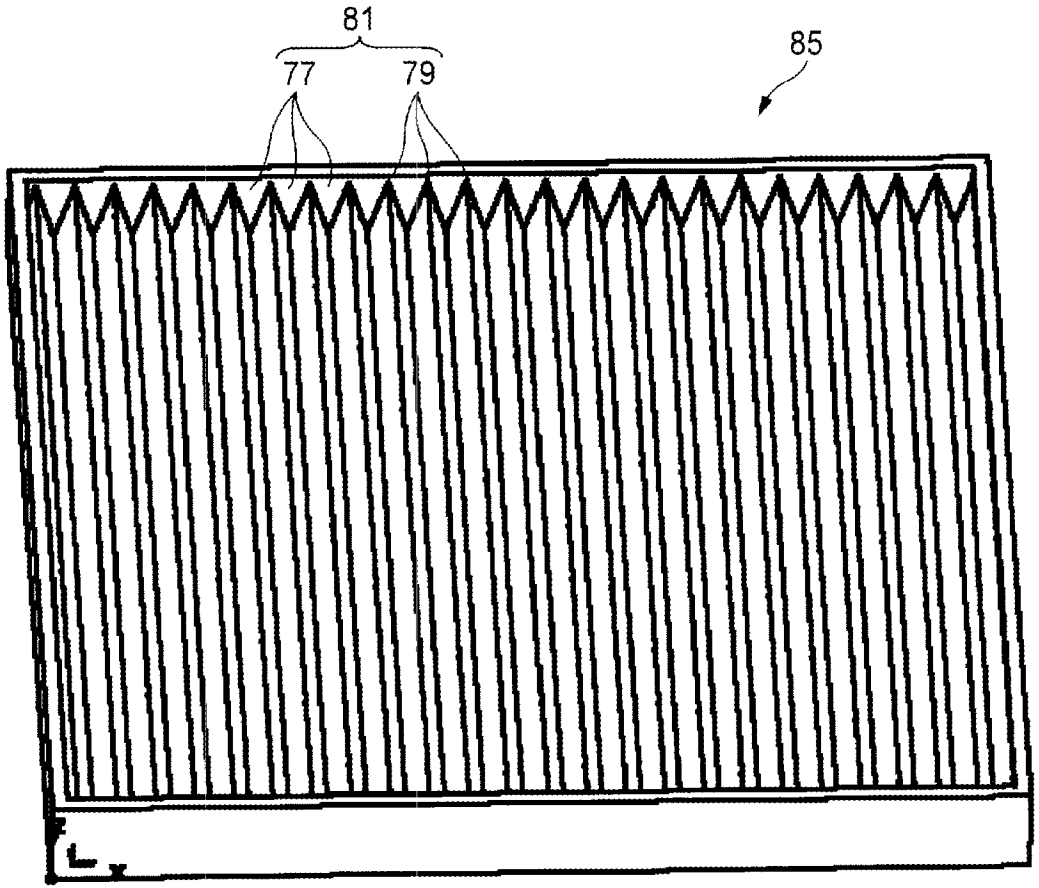
FIG. 7 is a perspective view of a thru-beam type filter of the multi-function printer of the present embodiment.

FIG. 1 is a longitudinal cross-sectional view of multi-function printer 11 of the present embodiment. FIG. 2 is a perspective view when first side wall 57 of multi-function printer 11 shown in FIG. 1 is viewed from fuser unit container 51 side. FIG. 3 is a perspective view when FIG. 2 is cut at an approximately center position in a long-side direction of heat roller 41. FIG. 4 is a perspective view when FIG. 3 is viewed from the lower portion of duct 53 side. FIG. 5 is a perspective view when exhaust port 63 of first side wall 57 is viewed from the upper portion in a state where ceiling surface 71 of the duct is not shown. FIG. 6 is a perspective view of filter 65. FIG. 7 is a perspective view of thru-beam type filter 85.

For example, multi-function printer 11 of the present embodiment includes functions such as scanning, copying, or printing, form (fuses) a monochromatic or multicolor image on a sheet (for example, a recording material or a recording sheet) based on print job data input from an external device (for example, a personal computer (PC) (not shown)), and discharges the sheet.

Multi-function printer 11 shown in FIG. 1 is configured to include at least photosensitive drum 13, charging unit 15, developing roller 17, transfer roller 19, exposure device 21, fuser unit 23, sheet feeding cassette (not shown), sheet transport roller 25, sheet discharging roller 27, and sheet discharging tray 29 in main body casing 31.

For example, one set of visible image forming units (process units) 33 is disposed at an approximately center inside main body casing 31 of multi-function printer 11 shown in FIG. 1. For ease of explanation, for example, it is described that one set of visible image forming units 33 is disposed to form a black image in multi-function printer 11 shown in FIG. 1. However, the visible image forming unit having the similar configuration for each different color (yellow, magenta, cyan) may be disposed.

Photosensitive drum 13 which has a role as an electrostatic latent image carrier according to print job data input into multi-function printer 11 is provided in visible image forming unit 33, and charging unit 15, developing roller 17, transfer roller 19, and cleaning unit 35 are disposed in the vicinity of photosensitive drum 13.

Charging unit 15 uniformly charges a predetermined potential (for example, negative potential) on the surface of photosensitive drum 13. For example, preferably, charging unit 15 is a charge roller type which can uniformly charge the surface of photosensitive drum 13 without generating ozone as much as possible during charging with respect to photosensitive drum 13. However, charging unit 15 is not limited to the charge roller type, and for example, may use a contact type brush or a non-contact charger type.

Developing roller 17 develops electrostatic latent image formed on photosensitive drum 13 by exposure device 21 described below using toner supplied to developing roller 17. Accordingly, a toner image corresponding to the print job data is obtained. In the present embodiment, for example, black toner is supplied to developing roller 17. In multi-function printer 11, toner of each color may be supplied to each developing roller of a visible image forming unit corresponding to each color of yellow, magenta, and cyan, and having the same configuration as visible image forming unit 33.

Transfer roller 19 is disposed to oppose photosensitive drum 13, and transfers the toner image formed on the surface of photosensitive drum 13 to sheet 37 which is transported along sheet transport path 45. Hereinafter, the toner image transferred to sheet 37 by transfer roller 19 is referred to as an "unfused toner image".

Cleaning unit 35 removes and recovers the toner which remains on the surface of photosensitive drum 13 after the transfer processing is performed in transfer roller 19.

Exposure device 21 includes a laser scanning unit (LSU) 39. Laser scanning unit 39 is configured to include a laser light source, a polygon mirror which performs scanning with the laser light emitted from the laser light source, a lens which introduces the laser light which performs the scanning by the polygon mirror into photosensitive drum 13, and a reflecting mirror. Laser scanning unit 39 exposes the surface of photosensitive drum 13 by the light from the polygon mirror according to the input print job data, and forms the electrostatic latent image according to the print job data on photosensitive drum 13.

Fuser unit 23 is configured to include heat roller 41 and pressure roller 43 which extend so as to be perpendicular to sheet 37. Heat roller 41 is heated to a predetermined target temperature (for example, fuse temperature within a range from 180° C. to 200° C.) by a heater which is a heat source. Pressure roller 43 is biased toward heat roller 41 by a spring (not shown). Fuser unit 23 heats and pressurizes sheet 37 to which the toner image is transferred in pressure roller 43 and heat roller 41, and thus, the unfused toner image is fused on sheet 37.

Sheet transport path 45 is formed from a sheet feeding cassette (not shown) to sheet discharging tray 29 in main body casing 31. Sheet transport path 45 is configured of a transport path which passes through fuser unit 23 from sheet transport roller 25 via a portion between photosensitive drum 13 and transfer roller 19, and reaches sheet discharging roller 27 (refer to an arrow A in FIG. 1). Sheet transport path 45 becomes sheet discharging path 47 immediately before sheet discharging roller 27. For example, a switchback transport path (not shown) for feeding sheet 37 to the position of transfer roller 19 again when a duplex printing is performed is provided in sheet discharging path 47.

A control portion (not shown) for integrally controlling all operations of multi-function printer 11 is provided in main body casing 31. The control portion is configured using a processor (for example, Central Processing Unit (CPU), Micro Processing Unit (MPU), and Digital Signal Processor (DSP)). The control portion controls each operation in each portion of multi-function printer 11, that is, photosensitive drum 13, charging unit 15, developing roller 17, transfer roller 19, exposure device 21, fuser unit 23, sheet transport roller 25, and sheet discharging roller 27. Control portion also controls the operation of exhaust fan 49 (refer to FIG. 2) described below.

In multi-function printer 11 having the above-described configuration, an image forming process is performed as follows by control portion of multi-function printer 11.

When the image forming is performed, first, sheets 37 are discharged from a sheet feeding cassette (not shown) to sheet transport path 45 one by one using sheet transport roller 25.

After charging unit 15 uniformly charges the surface of photosensitive drum 13, exposure device 21 exposes a charge region on the surface of photosensitive drum 13 by laser light according to the print job data input from the external device. Accordingly, the electronic latent image corresponding to the print job data is formed on the surface of photosensitive drum 13. Continuously, developing roller 17 develops the electronic latent image formed on the surface of the photosensitive drum 13 using the toner supplied by developing roller 17. Accordingly, the toner image corresponding to the print job data is obtained.

Transfer roller 19 transfers the toner image formed on the surface of photosensitive drum 13 to sheet 37 which is fed from the sheet feeding cassette (not shown) by sheet transport roller 25 and is transported. Accordingly, the unfused toner image corresponding to the print job data is transferred to sheet 37. The unfused toner image transferred to sheet 37 is transported to fuser unit 23. Fuser unit 23 sufficiently heats and pressurizes the unfused toner image in heat roller 41 and pressure roller 43 and fuses the unfused toner image on sheet 37. Accordingly, the image corresponding to the print job data is formed on sheet 37, and sheet 37 is discharged to sheet discharging tray 29 by sheet discharging roller 27.

Here, in multi-function printer 11 of the present embodiment, fuser unit container 51 for accommodating fuser unit 23 is provided in the vicinity of fuser unit 23. Fuser unit container 51 is formed as a cavity which has airtightness on a level in which the ultrafine particles (UFP) generated inside fuser unit container 51, that is, in fuser unit 23 are not leaked to the outside of fuser unit container 51.

More specifically, fuser unit container 51 is formed by connecting a plurality of metal plates and molding resin plates fixed to main body casing 31 to one another. Since fuser unit container 51 becomes a negative pressure by suction of exhaust fan 49 described below, existence of a small gap such as sheet transport path 45 communicating with the outside of the cavity is admitted. Outside air flows into fuser unit container 51 from the gap, and thus, fuser unit container 51 does not become a vacuum. An exclusive air feeding port may be provided in fuser unit container 51.

Duct 53 is provided so as to be adjacent to fuser unit container 51. Duct 53 is formed in a long shape in a direction along axis 59 (refer to FIG. 2) of heat roller 41, and is disposed in the vicinity of fuser unit 23 along axis 59 of heat roller 41. More specifically, duct 53 is formed in a long shape in the direction along axis 59 (refer to FIG. 2) of heat roller 41 with a portion of wall portion 55 in fuser unit container 51 as first side wall 57. Exhaust fan 49 (refer to FIG. 2) is provided on one end side in a long-side direction of duct 53, and exhaust fan 49 exhausts exhaust emissions including air existing in air transport space 61 (refer to FIG. 1) of duct 53 to the outside of main body casing 31.

Exhaust port 63 (refer to FIG. 2) is opened to first side wall 57 of fuser unit 23 side of duct 53, that is, first side wall 57 of wall portion 55 of fuser unit container 51. Exhaust port 63 causes fuser unit 23 and duct 53 to communicate with each other. More specifically, exhaust port 63 causes fuser unit container 51 which is provided so as to cover fuser unit 23 and duct 53 to communicate with each other. In the present embodiment, as shown in FIG. 2, a plurality of (two in FIG. 2) exhaust ports 63 are formed in the long-side direction of first side wall 57. A gap between exhaust ports 63 and an opening area of each exhaust port are set after container exhaust gas 87 described below is adjusted so as to be exhausted without variation in the long-side direction of fuser unit container 51.

Planar filter 65 is detachably attached to the inner wall surface of duct 53 so as to be parallel with inner wall surface. The inner wall surface of duct 53 is used as a collective name of ceiling surface 71, first side wall 57, second side wall 73, and bottom surface 75 of the duct. As shown in FIG. 6, in filter 65, filter main body 67 is held inside frame body 69. Frame body 69 is held and removed with respect to a locking structure and a holding portion (not shown) such as a rail provided inside duct 53, and thus, filter 65 is attached to and detached from duct 53.

In duct 53, a rectangular ceiling surface (ceiling surface 71 of the duct) of duct 53 in which the inner wall surface is along the long-side direction of duct 53 is formed. Filter 65 is attached to ceiling surface 71 of the duct, and specifically, preferably, filter is installed in a rectangular shape which covers ceiling surface 71 of the duct. As a result, if filter 65 has an area which can cover almost the entire ceiling surface 71 of the duct, filter 65 may be a single filter or a plurality of divided filters.

Filter 65 may be installed to cover all or a portion of first side wall 57, second side wall 73, and bottom surface 75 in addition to ceiling surface 71 of the duct. However, when filter 65 is provided on first side wall 57, filter is provided on a portion other than exhaust port 63 so that exhaust port 63 is not blocked.

Ceiling surface 71 of the duct is formed to be upwardly inclined so as to be heightened as ceiling surface 71 is away from exhaust port 63. In first side wall 57 and second side wall 73 opposing first side wall which are positioned in a state where ceiling surface 71 of the duct is interposed therebetween, an included angle between first side wall 57 and ceiling surface 71 and an included angle between second side wall 73 and ceiling surface 71 become acute angles.

As shown in FIG. 6, the surface of filter 65 is configured so as to have irregular surface 81 in which ditches 77 and convex portions 79 parallel with each other to be extended in a direction inclined to the long-side direction of duct 53 are alternately disposed in the long-side direction (arrow B direction in FIG. 6) of ceiling surface 71 of the duct. Since filter 65 has irregular surface 81, the surface area is increased.

Ditch 77 and convex portion 79 configuring irregular surface 81 may be formed in various shapes. For example, although it is not shown, ditch 77 may be formed in a V ditch, and convex portion 79 may be formed in an inverted V-shaped crest. Although it is not shown, in ditch 77 and convex portion 79, a valley bottom of the V groove and an apex of the inverted-V shaped crest are curved, and a so-called waveform of a sine wave shape may be configured. Although it is not shown, ditch 77 and convex portion 79 may be a recessed groove having a flat groove bottom and a protruding convex portion 79 having a flat apex.

In the present embodiment, thru-beam type filter 85 shown in FIGS. 5 and 7 is attached so as to cover exhaust opening surface 83 (refer to FIG. 2) of exhaust fan 49. As shown in FIG. 7, the surface of thru-beam type filter 85 is also formed to have irregular surface 81 in which ditches 77 and convex portions 79 parallel with each other are alternately disposed. Since thru-beam type filter 85 has irregular surface 81, the surface area is increased. Thru-beam type filter 85 passes container exhaust gas 87 (see below) which flows into via exhaust port 63. Similar to filter 65, thru-beam type filter 85 is also detachably attached to exhaust opening surface 83.

Next, an operation of multi-function printer 11 having the above-described configuration will be described.

In multi-function printer 11, the unfused toner image corresponding to the print job data input from the external device is transferred to sheet 37 and is transported to fuser unit 23. In fuser unit 23, sheet 37 is held by heat roller 41 and pressure roller 43. The unfused toner image carried to sheet 37 becomes an image fused on sheet 37 and is fused by heating of heat roller 41 and pressurizing of pressure roller 43.

At this time, in fuser unit 23, it is known that a very small quantity of toner configuring the unfused toner image is separated from the unfused toner image along water vapor according to vaporization of water included in sheet 37. In general, the toner is configured of pigment, wax, and an external additive. A primary effect of the external additive is to improve response efficiency between the external additive and static electricity, and for example, is used to attach minute particles such as silica on the toner surface. In recent years, there is a report that it is considered that the external additive particularly separated along with water vapor is one of factors increasing ultrafine particles (UFP) in multi-function printer 11.

In the present embodiment, the external additive separated from the toner surface along with the water vapor generated during the fusing of sheet 37 is carried to the upper portion of fuser unit container 51 along with air which is moved by natural convection and a suction force by exhaust fan 49. First side wall 57 which is a portion of wall portion 55 is positioned on the upper portion of fuser unit container 51. First side wall 57 becomes a partition between duct 53 provided to be adjacent to fuser unit container 51 and first side wall. Duct 53 is formed in a long shape in the direction along axis 59 of heat roller 41. That is, duct 53 is disposed to be adjacent in parallel with fuser unit 23 across the partition, and thus, compactification of multi-function printer 11 is realized. Exhaust port 63 is formed on first side wall 57 which is the partition, and exhaust port 63 causes the inside of fuser unit container 51, that is, an exposure space of fuser unit 23, and the inside (air transport space 61) of duct 53 to communicate with each other.

In duct 53, the air of air transport space 61 flows toward one end side in the long-side direction by exhaust fan 49 which is provided on one end side in the long-side direction. Accordingly, the air inside fuser unit container 51 is sucked into and flows into air transport space 61 of duct 53 which reaches a negative pressure via exhaust port 63. The external additive (ultrafine particles: UFP) separated from the toner surface along with the water vapor generated during the fusing of sheet 37 is mostly included in suction air (hereinafter, referred to as "container exhaust gas") along with other volatile organic compounds (VOC) and dust, and flows into air transport space 61 of duct 53.

When container exhaust gas 87 shown in FIGS. 2 and 3 is transferred to one end side in the long-side direction of duct 53, the container exhaust gas comes into contact with the surface of planar filter 65 which is attached in parallel with the inner wall surface of duct 53. Filter 65 and container exhaust gas 87 come into contact with each other, and thus, it is confirmed that the ultrafine particles (UFP) included in container exhaust gas 87 are captured by filter 65. Specifically, it is possible to confirm the capturing of ultrafine particles by measuring the amount of emission of the ultrafine particles at the outlet side of exhaust fan 49 when filter 65 is provided in duct 53 and when filter 65 is not provided in duct 53. It is considered that the reason why the ultrafine particles are captured by filter 65 disposed in parallel with container exhaust gas 87 is because container exhaust gas 87 becomes turbulent in the vicinity of the surface of filter 65 and as a result, a vortex is generated, and thus, the ultrafine particles are caught on the surface of filter 65 and therefore, are captured.

In filter 65, as the base material, vegetable fibers, mineral fibers, synthetic fibers, woven fabrics, non-woven fabrics, felts, webs, resin foamed bodies, porous films, or the like may be used. Even when any base material is used, lots of minute voids, that is, fiber clearances and holes are formed on the surface of filter 65.

In a portion in which container exhaust gas 87 flowing to air transport space 61 of duct 53 is far away from filter 65, the container exhaust gas uniformly flows and thus, a velocity gradient (velocity change) is not generated. Meanwhile, since sliding is not generated on the surface of filter 65, flow velocities are continuously changed by influence of a friction force in the vicinity of filter 65, and a region in which uniform flow is generated is formed. That is, a thin layer (boundary layer) having a great velocity gradient is covered on the surface of filter 65. It is considered that the ultrafine particles, in which transport energy is decreased by the boundary layer and the above-described vortex generated by the turbulence, are caught on minute voids on the filter surface and are captured. The boundary layer is changed by ultrafine particles (UFP) which are captured and deposited. It is considered that there are optimal values with respect to a relationship between the ultrafine particles (UFP) and the sizes of the minute voids, and the flow velocity of container exhaust gas 87.

In this way, in the present embodiment, since duct 53 is disposed in the vicinity of fuser unit 23 along axis 59 of heat roller 41, a wasteful space is not generated in multi-function printer 11. As a result, the configuration itself of multi-function printer 11 becomes simple and compact.

More specifically, in the present embodiment, duct 53 is also used as a portion of wall portion 55 of fuser unit container 51, and thus, it is possible to easily manufacture multi-function printer 11. Since duct 53 is disposed to be adjacent to fuser unit container 51 along (in parallel with) heat roller 41 only across the partition, wasteful space is not generated in multi-function printer 11. As a result, the configuration itself of multi-function printer 11 becomes simple and compact. It is also possible to easily replace filter 65, and thus, it is possible to improve maintenance of multi-function printer 11.

Since filter 65 is configured in a long shape along the long-side direction of duct 53, a contact time between container exhaust gas 87 and the filter is lengthened, probability of the ultrafine particles (UFP) being captured is increased, and it is possible to decrease the amounts of the ultrafine particles (UFP) exhausted to the outside of multi-function printer 11. Filter 65 does not cross air transport space 61 of duct 53, and is installed in parallel with the transport direction of container exhaust gas 87 in air transport space 61. Accordingly, unlike the thru-beam type filter in the related art, filter 65 can prevent an increase of resistance when air is transported, and in other words, filter 65 can prevent an increase of output of the exhaust fan.

In multi-function printer 11, filter 65 is installed on ceiling surface 71 of the duct, and thus, it is possible to allow container exhaust gas 87 including the water vapor generated during the fusing of sheet 37 and ultrafine particles (UFP) having buoyancy generated by ascending current to effectively come into contact with filter 65. Particularly, since container exhaust gas 87 immediately after exhaust fan 49 is stopped is moved at a low flow velocity in the vicinity of ceiling surface 71 of the duct and thereafter, the container exhaust gas stagnates, it is possible to effectively capture the ultrafine particles (UFP).

In multi-function printer 11, ceiling surface 71 of the duct is formed to be upwardly inclined so as to be heightened as ceiling surface 71 is away from exhaust port 63, and the included angle between second side wall 73 and ceiling surface 71 of the duct becomes an acute angle. Accordingly, air transport space 61 interposed between second side wall 73 and filter 65 becomes a corner space which is gradually narrowed toward the upper portion. In the corner space, by friction forces of second side wall 73 and filter 65, the flow velocity during the exhaust is gradually decreased toward the inner side which is the side remote from exhaust fan 49. It is assumed that container exhaust gas 87 including the ultrafine particles (UFP) which moves upwardly along with the water vapor ascends toward the corner space. Accordingly, it is possible to deposit the ultrafine particles (UFP) on filter 65 from the inner side of the corner space. As a result, it is possible to effectively use the surface of filter 65 from the inner side of the corner space.

In multi-function printer 11, filter 65 having irregular surface 81 in which ditches 77 and convex portions 79 are alternately disposed is installed in the transport direction of container exhaust gas 87. Transported container exhaust gas 87 repeatedly collides with ditches 77 and convex portions 79, and thus, a vortex is generated. Accordingly, in filter 65, it is possible to improve probability of the ultrafine particles (UFP) being captured by minute voids of filter 65.

In multi-function printer 11, the plurality of exhaust ports 63 are provided, and the gap and the area of each exhaust port 63 are appropriately set. Accordingly, compared to a case where one exhaust port 63 is provided, it is possible to suppress variation in an inflow amount of container exhaust gas 87 flowing in air transport space 61 of duct 53 in the long-side direction of duct 53.

In multi-function printer 11, container exhaust gas 87 passes through air transport space 61 of duct 53, and thus, container exhaust gas 87 including the exhaust emissions from fuser unit 23 is exhausted from exhaust opening surface 83 of exhaust fan 49 in a state where the ultrafine particles (UFP) are decreased. At this time, container exhaust gas 87 including the exhaust emissions from fuser unit 23 passes through thru-beam type filter 85, and thus, the remaining ultrafine particles are captured again. Thru-beam type filter 85 is provided over the entire cross-section of duct 53, and thus, it is possible to capture ultrafine particle secondarily. Filter 65 inside duct 53 and thru-beam type filter 85 may be installed so that filter performance is appropriately adjusted. For example, a replacement period of filter 65 inside duct 53 may be set to be lengthened, and a replacement period of thru-beam type filter 85 may be set to be shortened.

Here, in the configuration of the related art in which filter 65 is not provided in duct 53, the decrease of the ultrafine particles (UFP) is dependent on only thru-beam type filter 85. In this case, when thru-beam type filter 85 is thickened to improve capture performance of ultrafine particles (UFP), exhaust fan 49 having greater power is required, and thus, noise is also increased.

In contrast, in multi-function printer 11 of the present embodiment including filter 65 in duct 53, thru-beam type filter 85 may have an auxiliary performance. Accordingly, in multi-function printer 11 of the present embodiment, air resistance is not increased even when thru-beam type filter 85 is attached, and it is possible to suppress an increase in the output of exhaust fan 49.

In filter 65, ditches 77 and convex portions 79 extend in the inclined direction in the long-side direction of duct 53. As for the "inclination in the long-side direction of duct 53", two inclination directions are considered. One inclination direction is an inclination direction (separation inclination direction) in which the inclination end of one end side (exhaust fan 49 side) in the long-side direction of the duct of ditch 77 and convex portion 79 positioned on ceiling surface 71 of the duct is away from first side wall 57. On the other hand, the other inclination direction is an inclination direction (approach inclination direction) in which the inclination end of exhaust fan 49 side of ditch 77 and convex portion 79 positioned on ceiling surface 71 of the duct approaches first side wall 57.

Initially, container exhaust gas 87 flowing toward exhaust fan 49 in air transport space 61 of duct 53 flows into duct 53 in a direction orthogonal to the long-side direction of duct 53 from exhaust port 63 of first side wall 57. That is, the flow direction of container exhaust gas 87 is gradually curved from exhaust port 63, and is converted into a perpendicular direction. Strictly speaking, the flow direction becomes three-dimensional complicated flow lines which interfere with one another.

When ditches 77 and convex portions 79 are in the "separation inclination direction", container exhaust gas 87 immediately after the container exhaust gas flows from exhaust port 63 easily flows to the downstream side without inversely flowing along the extension directions of ditches 77 and convex portions 79. Accordingly, ditches 77 and convex portions 79 in the separation inclination direction easily come into contact with container exhaust gas 87 over the entire length in the extension direction. As a result, in the separation inclination direction, the time when ditches 77 and convex portions 79 come into contact with container exhaust gas 87 is lengthened.

Meanwhile, when ditches 77 and convex portions 79 are in the "approach inclination direction", container exhaust gas 87 immediately after the container exhaust gas flows from exhaust port 63 easily abuts the convex portions in a direction approximately orthogonal to the extension direction of convex portion 79. That is, container exhaust gas 87 collides with convex portions 79, turbulence is easily generated, and numerous vortexes are generated in the vicinity of filter 65. As a result, in ditches 77 and convex portions 79 in the approach inclination direction, probability of the ultrafine particles being captured by the minute voids of filter 65 itself is improved.

Which of the approach inclination direction and the separation inclination direction can capture more ultrafine particles can be confirmed by measuring the amounts of emission of the ultrafine particles in the outlet side of exhaust fan 49. As a result of the confirmation, it is understood that compared to the separation inclination direction, ditches 77 and convex portions 79 in the approach inclination direction increase efficiency of capturing the ultrafine particles.

Figure 8:
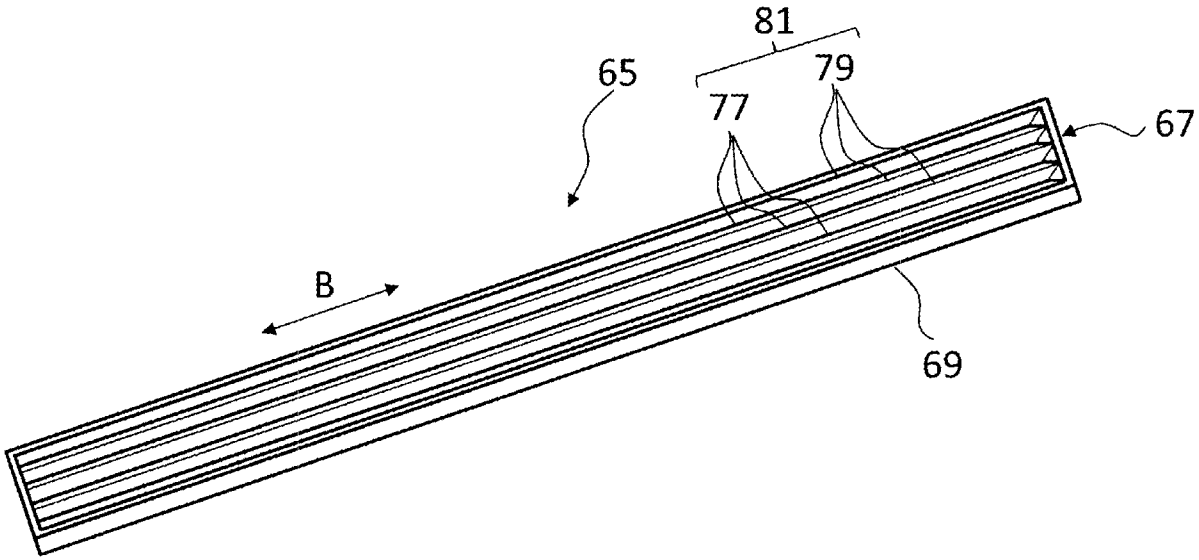
FIG. 8 is a perspective view of a filter in a multi-function printer of another embodiment.

As shown in FIG. 8, the surface of filter 65 may be formed to include irregular surface 81 on which ditches 77 and convex portions 79 extending in parallel with the long-side direction of duct 53 are alternately disposed in the short-side direction (a direction perpendicular to an arrow B of FIG. 8) of ceiling surface 71 of the duct. Also in this case, since filter 65 includes irregular surface 81, the surface area is increased. In FIG. 8, the same reference numerals are assigned to the same configurations as FIG. 6 and are described.

In the above-described configuration, since the duct is disposed in the vicinity of the fuser unit along the axis of the heat roller, a wasteful space is not generated in an image forming apparatus. As a result, the configuration itself of the image forming apparatus becomes simple and compact. It is also possible to easily replace the filter, and thus, it is possible to improve the maintenance of the image forming apparatus.

Since the filter is configured in a long shape along the long-side direction of the duct, a contact time between the exhaust gas and the filter is lengthened, the probability of the ultrafine particles being captured is improved, and it is possible to decrease the amounts of the ultrafine particles exhausted to the outside of the image forming apparatus. Since the filter does not cross air transport space of the duct, unlike the thru-beam type filter in the related art, the filter can prevent an increase of resistance when air is transported, and in other words, the filter can prevent the increase in the output of the exhaust fan.

The duct is also used as a portion of the wall portion of the fuser unit container, and thus, it is possible to easily manufacture the image forming apparatus. Since the duct is disposed to be adjacent to the fuser unit container along the pressure roller, wasteful space is not generated in the image forming apparatus. As a result, the configuration itself of the image forming apparatus becomes simple and compact. It is also possible to easily replace filter, and thus, it is possible to improve the maintenance of the image forming apparatus.

The planar filter is attached so as to be parallel with the inner wall surface of the duct. Since the filter is disposed so as to be parallel with the inner wall surface, it is possible to easily perform direct fixation with respect to the inner wall surface using a bonding agent, a double-sided adhesive tape, or the like. In the duct, since the filter is directly fixed to the inner wall surface, a decrease in the air transport space is suppressed to the minimum.

The filter is installed so as to be parallel with the ceiling surface of the duct, and thus, it is possible to allow the exhaust gas including the water vapor generated during the fusing of the sheet and ultrafine particles having buoyancy generated by the ascending current to effectively come into contact with the filter. Particularly, since the exhaust gas immediately after the exhaust fan is stopped is moved at a low flow velocity in the vicinity of the ceiling surface and thereafter, the exhaust gas stagnates, it is possible to effectively capture the ultrafine particles.

In the above-described configuration, the plurality of exhaust ports are provided, and the gap and the area of each exhaust port are appropriately set, and thus, compared to the case where one exhaust port is provided, it is possible to suppress variation in the inflow amount of the exhaust gas flowing in the air transport space of the duct in the long-side direction of the duct.

In the above-described configuration, the exhaust gas passes through the air transport space of the duct, and thus, the exhaust gas including the exhaust emissions from the fuser unit is exhausted from the exhaust opening surface of the exhaust fan in the state where the ultrafine particles are decreased. At this time, the exhaust gas passes through the thru-beam type filter, and thus, the remaining ultrafine particles are captured again. The thru-beam type filter is provided over the entire cross-section of the duct, and thus, it is possible to capture ultrafine particles secondarily.

As described above, various embodiments are described with reference to the drawings. However, it goes without saying that the present invention is not limited to the examples. It is clear to a person skilled in the art that various modifications and corrections may be applied within a scope described in claims, and various modifications and corrections are included in the technical range of the present invention.

According to the present invention, the present invention is useful as the image forming apparatus which decreases the amount of emission of the ultrafine particles and suppresses the increase in the output of the exhaust fan by the simple structure.

What is claimed is:

1. An image forming apparatus comprising:

a fuser unit extending in a longitudinal direction and including a heat roller and a pressure roller, which heats and pressurizes a sheet on which an unfused toner image is carried and fuses the unfused toner image on the sheet;

a duct provided adjacent to the fuser unit to form an air flow along an air-flowing direction in parallel with the longitudinal direction of the fuser unit;

an exhaust fan located on an axial end side of the duct in the air-flowing direction to exhaust the duct;

an exhaust port opened through a side wall of the duct to allow the fuser unit and the duct to communicate with each other; and a planar filter including a corrugated surface that defines valleys and ridges, each of the valleys and ridges extending in a first direction, the planer filter being attached to an inner wall surface of the duct such that the first direction of the valleys and ridges forms an acute angle with the air-flowing direction of the duct.

2. The imaging forming apparatus of claim 1, further comprising a fuser unit container which accommodates the fuser unit, wherein the side wall of the duct is integrally formed with a wall portion in the fuser unit container.

3. The imaging forming apparatus of claim 1, wherein the planar filter is attached, in parallel with the inner wall surface, to the inner wall surface of the duct.

4. The imaging forming apparatus of claim 1, wherein the inner wall surface includes a ceiling surface of the duct, and the planar filter is attached, in parallel with the ceiling surface, to the ceiling surface of the duct.

5. The imaging forming apparatus of claim 1, wherein the inner wall surface includes a ceiling surface of the duct, and the planar filter is attached to the ceiling surface.

6. The imaging forming apparatus of claim 1, wherein a plurality of the exhaust ports are opened through the side wall of the duct.

7. The imaging forming apparatus of claim 1, wherein a thru-beam type filter which passes exhaust emission from the fuser unit is attached to an exhaust opening surface of the exhaust fan.

* * * * *